US010400374B2

(12) United States Patent
Hashimoto et al.

(10) Patent No.: US 10,400,374 B2
(45) Date of Patent: Sep. 3, 2019

(54) SEWING MACHINE

(71) Applicant: Yamato Mishin Seizo Kabushiki Kaisha, Osaka-shi (JP)

(72) Inventors: Seiji Hashimoto, Toyonaka (JP); Ryuichiro Kinoshita, Toyonaka (JP)

(73) Assignee: YAMATO MISHIN SEIZO KABUSHIKI KAISHA, Osaka-Shi, Osaka (JP)

( * ) Notice: Subject to any disclaimer, the term of this patent is extended or adjusted under 35 U.S.C. 154(b) by 87 days.

(21) Appl. No.: 15/871,936

(22) Filed: Jan. 15, 2018

(65) Prior Publication Data

US 2018/0202088 A1 Jul. 19, 2018

(30) Foreign Application Priority Data

Jan. 18, 2017 (JP) ..... 2017-006375

(51) Int. Cl.

| | |
|---|---|
| ***D05B 35/02*** | (2006.01) |
| ***D05B 7/00*** | (2006.01) |
| ***D05B 27/12*** | (2006.01) |
| ***D05B 33/02*** | (2006.01) |
| ***D05B 55/02*** | (2006.01) |

(Continued)

(52) U.S. Cl.

CPC ..... *D05B 7/00* (2013.01); *D05B 3/04* (2013.01); *D05B 23/006* (2013.01); *D05B 27/12* (2013.01); *D05B 29/10* (2013.01); *D05B 33/02* (2013.01); *D05B 35/02* (2013.01); *D05B 35/08* (2013.01); *D05B 35/105* (2013.01); *D05B 55/02* (2013.01); *D05B 55/04* (2013.01); *D05D 2207/04* (2013.01); *D05D 2303/00* (2013.01); *D05D 2305/08* (2013.01)

(58) Field of Classification Search

CPC ..... D05B 35/02; D05B 7/00; D05B 33/02; D05B 29/10; D05B 2207/04; D05B 23/006

USPC ..... 112/470.31, 470.32, 306

See application file for complete search history.

(56) References Cited

U.S. PATENT DOCUMENTS 5,370,072 A * 12/1994 Adamski, Jr. ..... D05B 35/102 112/306

5,483,908 A * 1/1996 Nolle ..... D05B 35/02 112/141

(Continued)

FOREIGN PATENT DOCUMENTS

JP 2004236769 8/2004

*Primary Examiner* — Tajash D Patel

(74) *Attorney, Agent, or Firm* — Ladas & Parry, LLP

(57) ABSTRACT

A sewing machine includes a material sandwiching unit to sandwich two materials having annular edges from above and below while they are stacked so that the material on an inner wheel side is located on the lower side and the material on an outer wheel side is located on the upper side, wherein a part of the material sandwiching unit located above the two materials is vertically movable, the material sandwiching unit includes a curl-removing mechanism to straighten curls occurring on the edges of the two materials, the material sandwiching unit includes inclined parts that serve as the curl-removing mechanism and have edges extending backward from a farther side of the edges toward the edge side at a position where the two materials pass therethrough, and the inclined parts have air ejectors to eject air so as to form airflows that straighten portions of the materials where curls have occurred.

4 Claims, 5 Drawing Sheets

(51) Int. Cl.

| | |
|---|---|
| ***D05B 55/04*** | (2006.01) |
| ***D05B 35/10*** | (2006.01) |
| ***D05B 3/04*** | (2006.01) |
| ***D05B 29/10*** | (2006.01) |
| ***D05B 35/08*** | (2006.01) |
| ***D05B 23/00*** | (2006.01) |

(56) References Cited

U.S. PATENT DOCUMENTS

| | | | | |
|---|---|---|---|---|
| 5,765,495 | A * | 6/1998 | Adamski, Jr. ..... | D05B 33/02<br>112/306 |
| 2018/0016722 | A1 * | 1/2018 | Ueda ..... | D05B 29/10 |

* cited by examiner

SEWING MACHINE

CROSS-REFERENCE TO RELATED APPLICATION

This application claims priority to Japanese Patent Application No. 2017-006375, filed on Jan. 18, 2017, the disclosure of which is incorporated herein by reference in its entirety.

BACKGROUND OF THE INVENTION

Field of the Invention

The present invention relates to a sewing machine used for sewing two materials having annular edges.

Background Art

Conventionally, when sewing a tubular sleeve to a tubular body such as sleeving operation of T-shirts, an overlock sewing machine, for example, shown in JP 2004-236769 A has been used. When sewing the sleeve to the body in this example, two materials (the material of the body and the material of the sleeve) having annular edges are sewn together. In the case of using the overlock sewing machine, the annular edges of the materials are sewn while they are located above a stitch plate of the overlock sewing machine.

In such a conventional sewing method, the materials cover over the position where a needle that performs the sewing passes through the materials on the stitch plate (needle drop slot), thereby blocking the sight of the sewing operator. Therefore, the sewing operator has been forced to take a tough posture such as a posture of lifting the materials, in order to ensure the sight so as to check the sewing state. Moreover, one hand needs to be used for lifting the materials or the like, and therefore the positioning of the two materials has been also difficult. Accordingly, the operation efficiency has decreased to hinder the mass production of sewn products.

SUMMARY OF THE INVENTION

In view of the aforementioned problems, it is therefore an object of the present invention to provide a sewing machine that allows good operation efficiency, particularly, when sewing two materials having annular edges.

The following presents a simplified summary of the invention disclosed herein in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

The present invention is a sewing machine including: a cylinder unit configured to support two materials having annular edges by being inserted therethrough while they are stacked so that one is located on an inner wheel side and the other is located on an outer wheel side; a stitch plate configured to abut the material on the inner wheel side that is supported by the cylinder unit so as to support it from below; a material presser configured to press the material on the outer wheel side that is supported by the cylinder unit above the stitch plate; and a material sandwiching unit provided on a near side of the stitch plate and the material presser and configured to sandwich the two materials from above and below while they are stacked so that the material on the inner wheel side is located on the lower side and the material on the outer wheel side is located on the upper side, wherein a part of the material sandwiching unit that is located above the two materials is vertically movable, the material sandwiching unit includes a curl-removing mechanism configured to straighten curls occurring on the edges of the two materials, the material sandwiching unit includes inclined parts that serve as the curl-removing mechanism and have edges of shapes extending backward from a farther side of the edges of the materials toward the edge side at a position where the edges of the two materials pass therethrough, and the inclined parts have air ejectors configured to eject air so as to form airflows that straighten portions of the materials where the curls have occurred.

The configuration can further include an edge guide located closer to a front side than the curl-removing mechanism is and configured to abut the edges of the two materials.

The configuration can be such that the air ejectors are constituted by a plurality of air ejection holes opening in the inclined parts.

BRIEF DESCRIPTION OF THE DRAWINGS

The foregoing and other features of the present invention will become apparent from the following description and drawings of an illustrative embodiment of the invention in which.

DETAILED DESCRIPTION OF THE PREFERRED EMBODIMENT

Next, the present invention will be described with reference to an embodiment. In order to express the forward and backward directions, the closer side to the sewing operator will be referred to as "near side", and the farther side will be referred to as "back side (rear side)". Further, the upward, downward, left, and right directions are expressed as directions when a sewing machine 1 is seen from the operator.

The sewing machine 1 of this embodiment is suitable as a "sewing machine dedicated to sleeving", and is, for example, an overlock sewing machine used for operation of joining tubular materials to each other such as operation of sewing a tubular sleeve to an arm through hole of a tubular body (T-shirt sleeving operation, for example). The edge of the arm through hole of the body, through which an arm of a wearer of the cloth passes, and the edge of the sleeve are annular and remain unchanged from the state where they have been cut without being subjected to processing such as folding, in this embodiment. The T-shirt sleeving operation is just an example, and the sewing machine 1 of this embodiment can be used widely for operations of sewing annular edges of two materials to each other. Further, as the tubular materials, materials formed by circular knitting so as not to have a joint (side seam) in the circumferential direction can be used.

Figure 1:
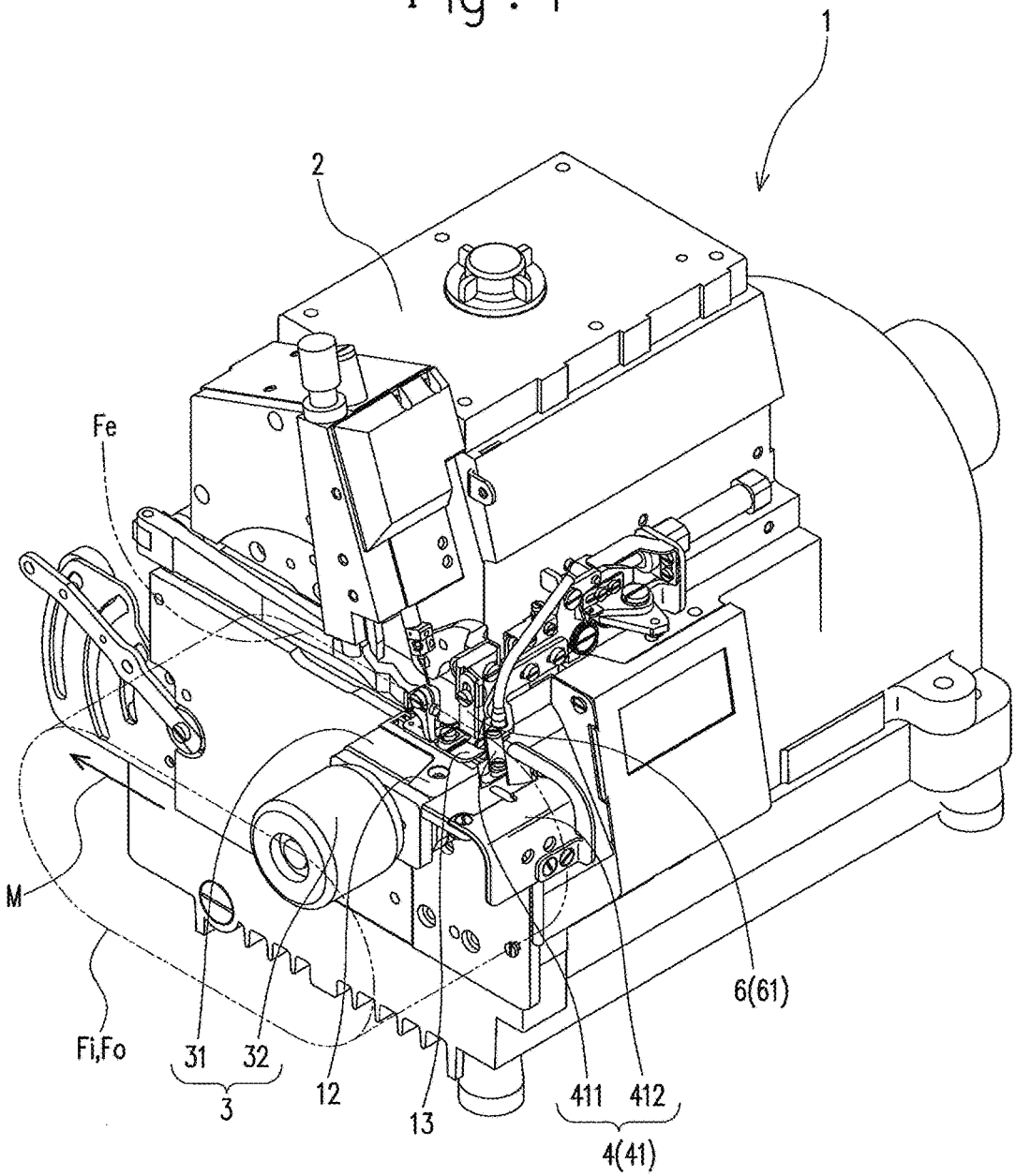
FIG. 1 is a perspective view showing a sewing machine of the present embodiment.

As shown in FIG. 1, the sewing machine 1 sews two materials Fi and Fo (shown by dashed lines in the figure) that have annular edges and are stacked inside and outside so that one is located on the inner wheel side and the other is located on the outer wheel side. The two materials Fi and Fo of this embodiment are the material of the body and the material of the sleeve, for example, in a T-shirt and are independent and separate (not continuous) materials.

The sewing machine 1 of this embodiment includes a sewing machine body 2, a cylinder unit 3 projecting from the sewing machine body 2 toward one side (specifically, the left side), a curl-removing mechanism 4, an edge guide 5, and a material cutting mechanism 6. Mechanisms in common with general sewing machines are not described in detail except for those particularly in need of explanation.

The cylinder unit 3 is a part configured to support the two materials Fi and Fo on the inner wheel side and the outer wheel side from below by being inserted therethrough while they are stacked. Since the cylinder unit 3 can be inserted through the two materials Fi and Fo, the annular edges of the materials Fi and Fo can be sewn below a stitch plate 12, as being different from the conventional overlock sewing machine, for example, disclosed in JP 2004-236769 A.

Figure 2:
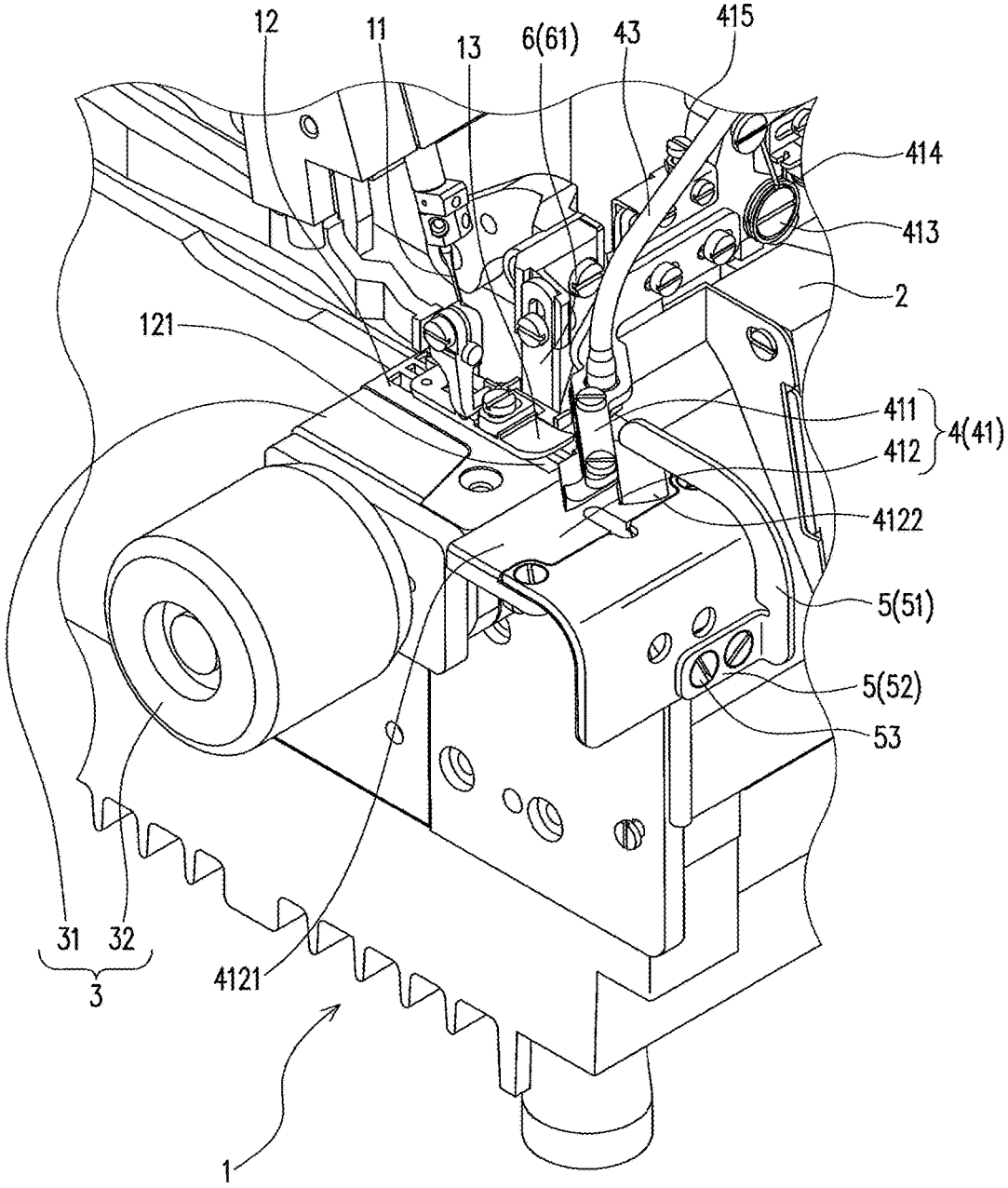
FIG. 2 is an enlarged perspective view of a main part of the sewing machine of the aforementioned embodiment as seen from the left front side.

As shown in FIG. 2, the cylinder unit 3 of this embodiment includes a cylinder body 31 projecting to the left from the sewing machine body 2, and a roller unit 32 projecting to the left from the cylinder body 31 and configured to be freely rotatable about a rotation axis extending in the left and right directions. The stitch plate 12 is provided on the top of the cylinder body 31. The roller unit 32 rotates as the two materials Fi and Fo are fed backward, that is, in the feed direction M (see FIG. 1). Therefore, the two materials Fi and Fo can be smoothly fed backward from the near side above the cylinder unit 3.

Since the cylinder unit 3 can be inserted through the two materials Fi and Fo having annular edges, the materials Fi and Fo can be sewn, with their annular edges being located below the stitch plate 12, as shown in FIG. 1. Therefore, the materials do not cover over the position where a needle 11 that performs the sewing passes through the materials (needle drop slot) on the stitch plate 12, and thus the sight of the sewing operator is less likely to be blocked by the materials Fi and Fo. Further, there is no need to use one hand for ensuring the sight, and therefore both hands can be concentrated on the sewing operation.

In particular, the shape of the annular edge of the arm through hole of the tubular body and the shape of the annular edge of the sleeve, which are, for example, materials of a T-shirt, are not completely the same as each other in most cases, such as that the flat degree is different or a joint is present in the middle in the circumferential direction. Therefore, the operator constantly performs fine adjustment for positioning the two materials Fi and Fo during the sewing operation. Since the sewing machine 1 of this embodiment allows both hands to be concentrated on the sewing operation as described above, the fine adjustment can be reliably performed. Therefore, the sewing quality can be improved, and the sewing operation can be accelerated, so that the operation efficiency can be improved, and sewn products can be mass-produced. Accordingly, the production cost of the sewn products can be reduced.

As shown in FIG. 2, the sewing machine 1 of this embodiment includes the needle 11 configured to reciprocally move during the sewing, the stitch plate 12 configured to receive the reciprocally moving needle 11, a material presser 13, and a drive mechanism, a transmission mechanism, or the like, for operating each unit, which are not shown. The stitch plate 12 is provided on the top of the cylinder body 31 of the cylinder unit 3 and has a needle drop slot (not shown) capable of receiving the reciprocally moving needle 11. The stitch plate 12 abuts the material Fi on the inner wheel side supported by the cylinder unit 3 and supports it from below. Though not clearly shown in the figure, the stitch plate 12 has a feeding mechanism 121 configured to feed the material Fi on the inner wheel side backward. The material presser 13 presses the material Fo on the outer wheel side supported by the cylinder unit 3 above the stitch plate 12. The two materials Fi and Fo on the inner wheel side and the outer wheel side are sandwiched between the stitch plate 12 and the material presser 13, and therefore both pieces are fed backward by the feeding mechanism 121 during the sewing.

The curl-removing mechanism 4 is a mechanism configured to straighten curls C occurring on the edges Fe on the sewing side of the two materials Fi and Fo on the inner wheel side and the outer wheel side. The curls C that can be straightened by the curl-removing mechanism 4 are portions formed by the regions in the vicinity of the edges Fe of the materials Fi and Fo on the sewing side curling along the edges (see FIG. 4; the lower ends of the materials are shown as being cut in FIG. 4 for convenience of explanation, though they are actually annular). In particular, when the materials Fi and Fo are stretched in the forward and backward directions, the curls C tend to occur.

Figure 3:
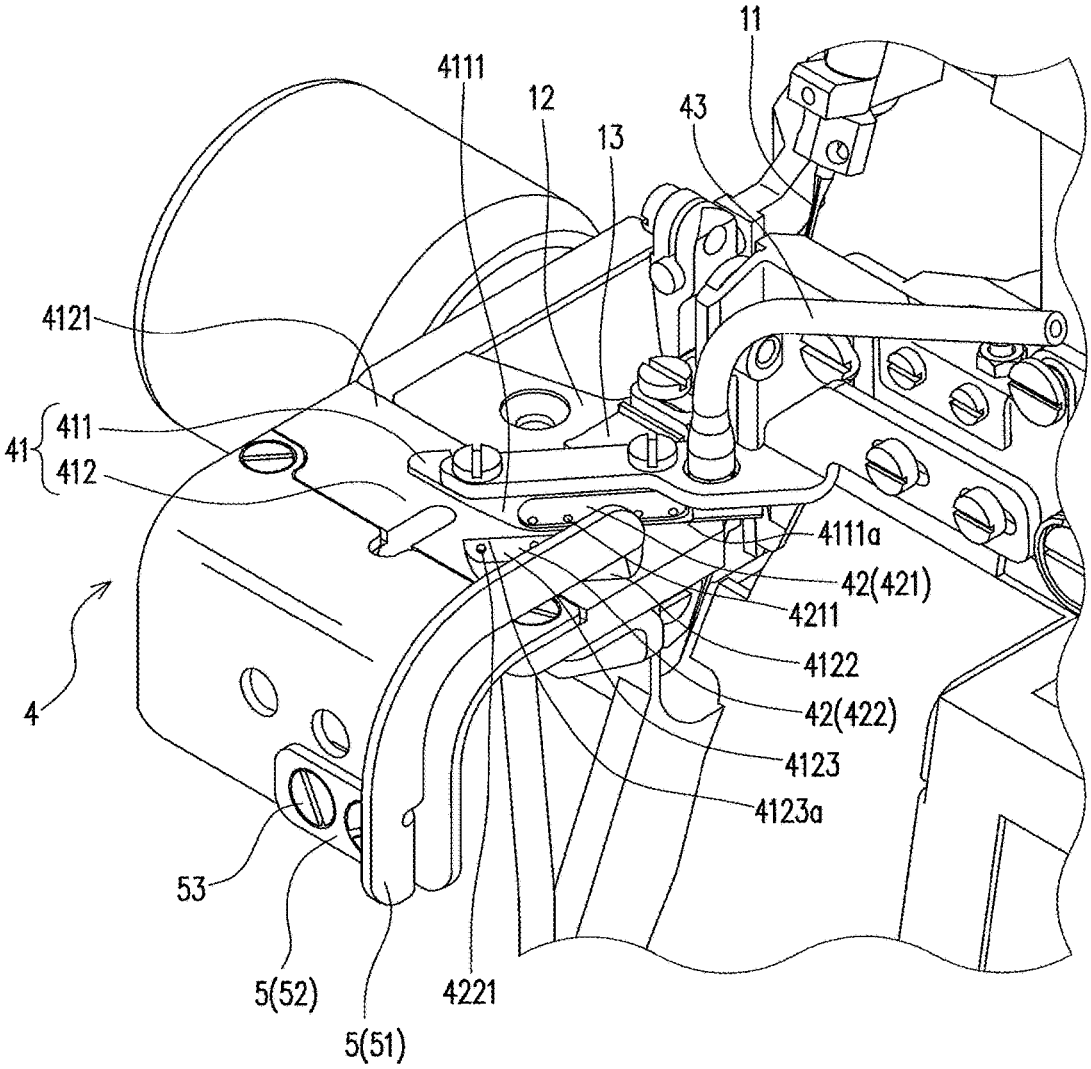
FIG. 3 is an enlarged perspective view of the main part of the sewing machine of the aforementioned embodiment as seen from the right front side.

As shown in FIG. 3, the curl-removing mechanism 4 of this embodiment includes a material sandwiching unit 41 and air ejectors 42. The material sandwiching unit 41 is provided on the near side of the stitch plate 12 and the material presser 13. The material sandwiching unit 41 sandwiches the two materials Fi and Fo from above and below while they are stacked so that the material Fi on the inner wheel side is located on the lower side and the material Fo on the outer wheel side is located on the upper side. Therefore, the material sandwiching unit 41 includes an upper material sandwiching unit 411 located on the upper side and a lower material sandwiching unit 412 located on the lower side. Further, the material sandwiching unit 41 includes a movement fulcrum 413, a biasing part 414, and a space restricting part 415. The respective portions of the upper material sandwiching unit 411 and the lower material sandwiching unit 412 opposed to the materials Fi and Fo are formed as flat surfaces.

The lower material sandwiching unit 412 is an immovable member fixed to the near side of the stitch plate 12. The lower material sandwiching unit 412 includes an upper surface 4121 and a recess 4122 in an upper part. At least a portion of the upper surface 4121 that is opposed to the upper material sandwiching unit 411 is a flat surface.

The moving mechanism allows the spacing in the vertical direction between the upper material sandwiching unit 411 and the lower material sandwiching unit 412 to be variable. In this embodiment, the moving mechanism is a mechanism that allows the upper material sandwiching unit 411 to be pivotable about the movement fulcrum 413 within a specific range relative to the lower material sandwiching unit 412 that is immovable. Therefore, the upper material sandwiching unit 411 is vertically movable. As the movement fulcrum 413, a screw is used in this embodiment, but the configuration is not limited as long as it can support the movement of the upper material sandwiching unit 411 relative to the lower material sandwiching unit 412. The moving mechanism includes an operating part, which is not shown, and the operating part is operated by the operator when the two materials Fi and Fo are sandwiched between the material sandwiching units 411 and 412, so that the material sandwiching units 411 and 412 can be moved so as to vertically move away from each other in the vertical direction. In this embodiment, the upper material sandwiching unit 411 is configured to pivot relative to the lower material sandwiching unit 412, but the configuration may be, for example, such that the upper material sandwiching unit 411 and the lower material sandwiching unit 412 are perpendicularly moved in the perpendicular direction while they are kept parallel to each other. Further, the configuration can be also such that only the lower material sandwiching unit 412 is moved, or both of the upper material sandwiching unit 411 and the lower material sandwiching unit 412 are moved.

In this embodiment, the biasing part 414 is a coil spring provided around the screw serving as the movement fulcrum 413, and the spacing between the upper material sandwiching unit 411 and the lower material sandwiching unit 412 is maintained by the bias of the biasing part 414. Therefore, in the case where portions of the materials Fi and Fo having an increased thickness, for example, due to tapes being attached thereto pass through the material sandwiching unit 41, such as the case of sleeves of T-shirts, the spacing between the upper material sandwiching unit 411 and the lower material sandwiching unit 412 expands due to the upper material sandwiching unit 411 moving upward, and after the portions pass therethrough, the spacing automatically returns to the original setting by the bias of the biasing part 414. Therefore, even if there are portions having increased thickness are present in the materials Fi and Fo, the variation in thickness can be followed well, and therefore the sewing is not hindered. The spacing between the upper material sandwiching unit 411 and the lower material sandwiching unit 412 is adjustable by a bolt provided in the space restricting part 415.

The two materials Fi and Fo sandwiched by the material sandwiching unit 41 can be fed between the stitch plate 12 and the material presser 13. Therefore, stable sewing is possible.

Further, there is only a space to sandwich the two materials Fi and Fo between the upper material sandwiching unit 411 and the lower material sandwiching unit 412, and thus a plate-shaped separator or the like, for example, configured to separate the two materials Fi and Fo does not intervene therebetween. Therefore, there is no need to retract the separator or the like before the materials Fi and Fo that are being fed backward reach the needle drop slot of the stitch plate 12, and thus there is no need to reduce the sewing speed or to temporarily stop the sewing operation, which is advantageous in mass production of sewn products.

As shown in FIG. 3, the material sandwiching unit 411 further has an inclined part 4111 extending backward from the farther side of the edges of the materials Fi and Fo (left side in this embodiment) toward the edge side (right side in this embodiment) at the position where the edges (right edges in this embodiment) of the two materials Fi and Fo on the sewing side pass therethrough. Likewise, also in the lower material sandwiching unit 412, an inclined part 4123 that is the inner surface having a shape extending backward from the farther side of the edges of the materials Fi and Fo (left side in this embodiment) to the edge side (right side in this embodiment) is formed in the recess 4122. The inclined parts 4111 and 4123 are provided at substantially coincident positions in the vertical direction and intersect the motion trajectory of the edges (right edges) Fe of the two materials Fi and Fo on the sewing side.

The inclined parts 4111 and 4123 of this embodiment each have a shape extending backward from the body side (left side in this embodiment) toward the sleeve distal end side (right side in this embodiment) at the position where the edges Fe (right edges in this embodiment) of the two materials Fi and Fo on the sewing side pass therethrough. The "shape extending backward" means a shape such that each of the edges 4111*a* and 4123*a* of the inclined parts 4111 and 4123 seem like "a line rising to the right" when the material sandwiching unit 41 is seen from above. Further, the edges 4111*a* and 4123*a* have linear shapes. However, there is no limitation to this configuration, and the edges 4111*a* and 4123*a* can have curved shapes, for example.

The air ejectors 42 include an upper air ejector 421 and a lower air ejector 422. The upper air ejector 421 is provided to be open in the inclined part 4111 of the upper material sandwiching unit 411 and has a plurality (five circular holes in this embodiment, but the shape and the number thereof are not specifically limited) of air ejection holes 4211. In this embodiment, the upper air ejector 421 is provided at a position recessed one step from the inclined part 4111 but can be provided on the same plane as the inclined part 4111. Compressed air is supplied through an air pipe 43 connected to the upper material sandwiching unit 411, so that airflows can be ejected through the air ejection holes 4211.

The lower air ejector 422 is provided in the inclined part 4123 of the lower material sandwiching unit 412 and has a plurality (three circular holes in this embodiment, but the shape and the number thereof are not specifically limited) of air ejection holes 4221. Compressed air is supplied through the air pipe 43 (shown in FIG. 4) connected to the lower material sandwiching unit 412, so that airflows can be ejected through the air ejection holes 4221.

Figure 4:
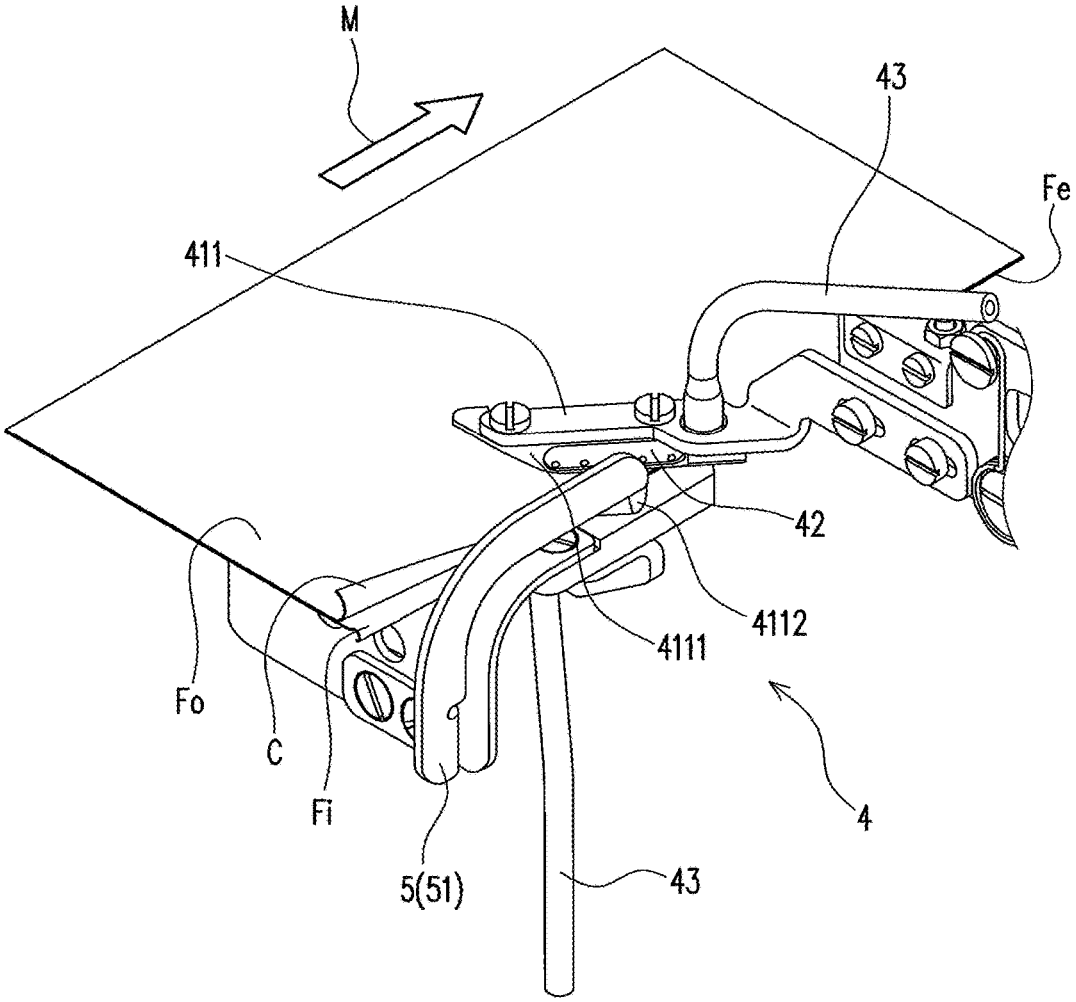
FIG. 4 is a schematic perspective view of a curl-removing mechanism and an edge guide taken out of the sewing machine of the aforementioned embodiment, showing an appearance of curls that have occurred in the materials being straightened by a material sandwiching unit.

The two materials Fi and Fo are moved backward, that is, in the feed direction M while they are sandwiched between the upper material sandwiching unit 411 and the lower material sandwiching unit 412. Therefore, as shown in FIG. 4, the curls C occurring on the edges Fe (right edges) of the two materials Fi and Fo on the sewing side are pressed to be expanded to the right by the inclined parts 4111 and 4123 of the upper material sandwiching unit 411 and the lower material sandwiching unit 412, so as to be flattened while being opposed to each other according to the spacing between the upper material sandwiching unit 411 and the lower material sandwiching unit 412. Thus, the curls C are straightened.

Further, the portions of the materials Fi and Fo where the curls C have occurred can be moved to the right by the pressure of the airflows ejected from the air ejectors 42 (the upper air ejector 421 and the lower air ejector 421), and therefore the curls C can be straightened. Thus, in this embodiment, the curls C can be straightened by both the inclined parts 4111 and 4123 and the airflows ejected from the air ejectors 42. Therefore, the curls C can be effectively removed.

As shown in FIG. 1 and FIG. 2, the edge guide 5 is located closer to the near side than the curl-removing mechanism 4 is. The edge guide 5 has a flat plate 51 and a fixed piece 52. The flat plate 51 is arranged along the forward and backward directions so as to project from the surface of the lower material sandwiching unit 412 and abuts the edges of the two materials Fi and Fo on the inner wheel side and the outer wheel side. Thus, the two materials Fi and Fo before being sewn can be positioned. In this embodiment, the outer edge of the flat plate 51 on the side opposite to the lower material sandwiching unit 412 on the flat plate 51 is open, and therefore even if there are portions having increased thickness, for example, due to tapes being attached to the materials Fi and Fo, such as the case of sleeves of T-shirts, the feeding of the materials Fi and Fo is not delayed because such portions get over the outer edge of the flat plate 51. The fixed piece 52 is fixed to the lower material sandwiching unit 412 by a screw 53. The edge guide 5 is movable in the left and right directions with respect to the lower material sandwiching unit 412 by loosening the screw 53. However, there is no limitation to this configuration, and the edge guide 5 can be fixed.

Figure 5:
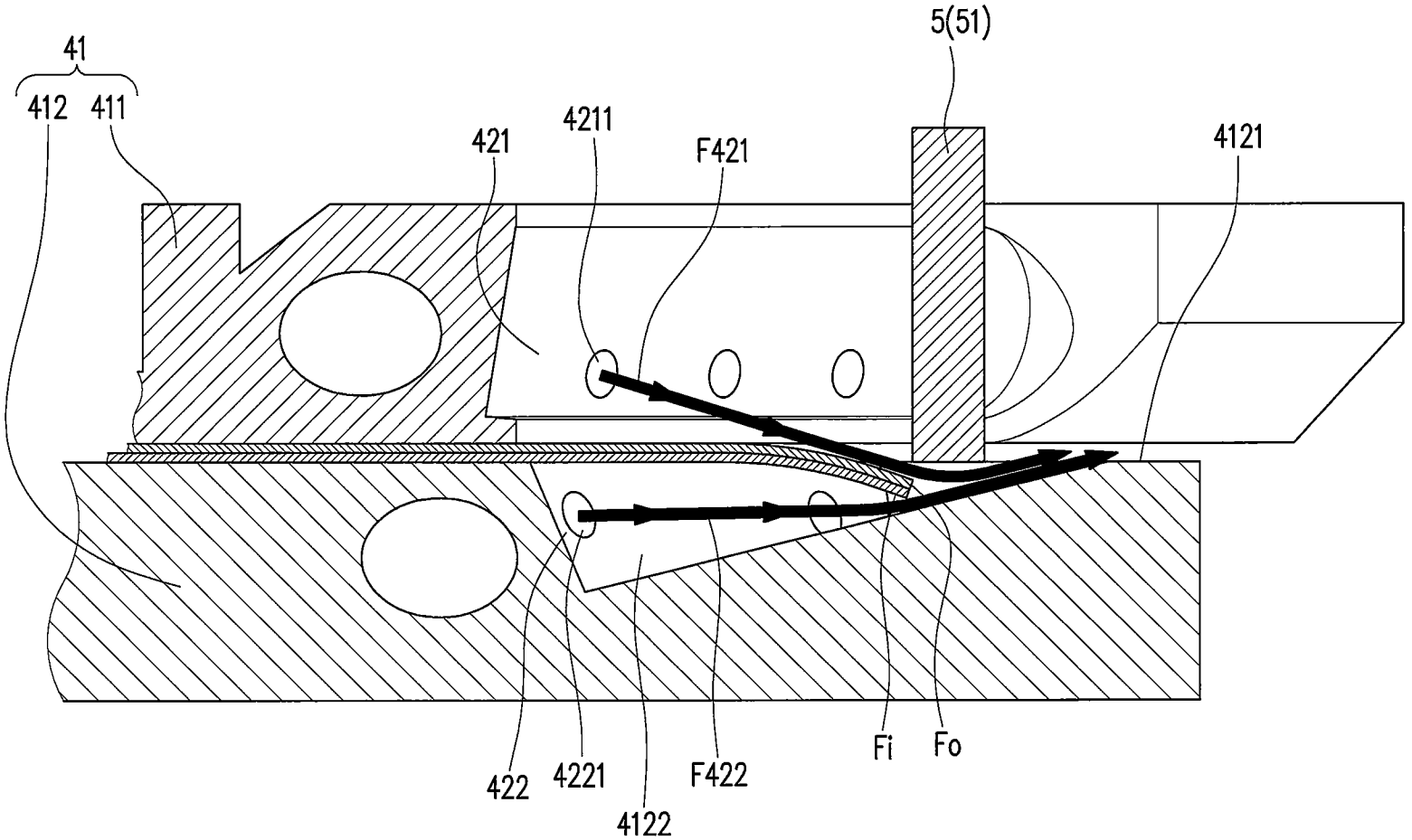
FIG. 5 is an explanatory diagram showing airflows passing through a recess formed in a lower material sandwiching unit of the sewing machine of the aforementioned embodiment.

In particular, in this embodiment, the flat plate 51 is located above the recess 4122 formed in the lower material sandwiching unit 412 so as to traverse it in the forward and backward directions. In other words, the upper region of the recess 4122 is divided into two by the flat plate 51 in plan view. Therefore, the airflows ejected from the lower air ejector 422 flow from the left to the right of the flat plate 51 as seen from the near side and is released into the atmosphere from the right side of the flat plate 51. As shown in FIG. 4, the left part of the flat plate 51 in the recess 4122 is covered by the materials Fi and Fo, but an area above the right part of the flat plate 51 in the recess 4122 is open, and therefore the airflows can be discharged through the recess 4122 without hindrance, as shown by the arrows in FIG. 5. Such a configuration can reduce the hindrance in removing the curls C, for example, due to airflows remaining inside the recess 4122 and can reliably remove the curls C. Since the materials Fi and Fo are flex, the airflows through the air ejection holes 4211 of the upper air ejector 421 also partially flow from the left to the right, passing through the lower part of the flat plate 51 (the recess 4122), as shown in FIG. 5.

As shown in FIG. 2, the material cutting mechanism 6 includes a knife 61. The knife 61 is a known mechanism which is configured to be capable of cutting a specific range of the edges of the two materials Fi and Fo by reciprocally moving a blade on the tip and is located behind the edge guide 5. The knife 61 cuts the two materials Fi and Fo at a specific distance that is away from the edge guide 5 backward, that is, in the feed direction M.

As described above, the edge guide 5 of this embodiment can move the fixed piece 52 in the left and right directions by loosening the screw 53 fixing the fixed piece 52 to the lower material sandwiching unit 412. Thus, the relative position of the edge guide 5 and the knife 61 of the material cutting mechanism 6 is adjustable to be able to change the specific distance. The width of the two materials Fi and Fo on the inner wheel side and the outer wheel side to be cut by the knife 61 can be optionally set by adjusting the relative position of the edge guide 5 and the knife 61. Therefore, the two materials Fi and Fo cut to a constant width can be sewn, thereby allowing desired sewn products to be stably and efficiently produced.

The edge guide 5 and the material cutting mechanism 6 automatically perform the processes of positioning the edges of the two materials Fi and Fo after the curls C are straightened and thereafter cutting the specific range from the edges. Therefore, the processes on the edges of the two materials Fi and Fo are performed with high accuracy and uniformity. Accordingly, sewn products with high quality can be efficiently produced.

As above, an embodiment of the present invention has been described, but the present invention is not limited to the aforementioned embodiment, and various modifications can be made without departing from the gist of the present invention.

The configuration and operation of the aforementioned embodiment will be summarized below. The aforementioned embodiment is a sewing machine 1 including: a cylinder unit 3 configured to support two materials Fi and Fo having annular edges by being inserted therethrough while they are stacked so that one is located on the inner wheel side and the other is located on the outer wheel side; a stitch plate 12 configured to abut the material Fi on the inner wheel side that is supported by the cylinder unit 3 so as to support it from below; a material presser 13 configured to press the material Fo on the outer wheel side that is supported by the cylinder unit 3 above the stitch plate 12; and a material sandwiching unit 41 provided on the near side of the stitch plate 12 and the material presser 13 and configured to sandwich the two materials Fi and Fo from above and below while they are stacked so that the material Fi on the inner wheel side is located on the lower side and the material Fo on the outer wheel side is located on the upper side, wherein a part of the material sandwiching unit 41 that is located above the two materials Fi and Fo is vertically movable, the material sandwiching unit 41 includes a curl-removing mechanism 4 configured to straighten curls C occurring on the edges of the two materials Fi and Fo, the material sandwiching unit 41 has inclined parts 4111 and 4123 that serve as the curl-removing mechanism 4 and have edges of shapes extending backward from the farther side of the edges of the materials Fi and Fo toward the edge side at the position where the edges of the two materials Fi and Fo pass therethrough, and the inclined parts 4111 and 4123 have air ejectors 421 and 422 configured to eject air so as to form airflows that straighten portions of the materials Fi and Fo where curls C have occurred.

According to this configuration, the cylinder unit 3 can be inserted through the two materials Fi and Fo having annular edges, so that the materials Fi and Fo can be sewn, with their annular edges being located below the stitch plate 12. Therefore, the sight of the sewing operator is less likely to be blocked by the materials Fi and Fo. Further, there is no need to use one hand for ensuring the sight, and therefore both hands can be concentrated on the sewing operation. Further, the two materials Fi and Fo sandwiched by the material sandwiching unit 41 can be fed into between the stitch plate 12 and the material presser 13. Therefore, stable sewing is possible.

Further, the material sandwiching unit 41 has the inclined parts 4111 and 4123 serving as the curl-removing mechanism 4, thereby making it easy to allow the material sandwiching unit 41 to extend along the portions where the curls C have occurred on the edge of the two materials Fi and Fo. Therefore, the curls C can be straightened up. Accordingly, the sewing is not interfered by the curls C, and the sewing operation can be efficiently performed.

Further, the configuration can further include an edge guide 5 located closer to the front side than the curl-removing mechanism 4 is and configured to abut the edges of the two materials Fi and Fo.

According to this configuration, the edge guide 5 automatically performs the processes of positioning the edges of the two materials Fi and Fo after the curls C have been straightened. Therefore, the processes on the edges of the two materials Fi and Fo are performed with high accuracy and uniformity. Accordingly, sewn products with high quality can be efficiently produced.

Further, the air ejectors 421 and 422 can be constituted by a plurality of air ejection holes 4211 and 4221 opening in the inclined parts 4111 and 4123.

According to this configuration, the portions of the materials Fi and Fo where the curls C have occurred are moved by the pressure of the airflows ejected through the plurality of air ejection holes 4211 and 4221 opening in the inclined parts 4111 and 4123, so that the curls C can be straightened. Therefore, the curls C can be effectively removed.

As described above, according to the aforementioned embodiment, the sight of the sewing operator is less likely to be blocked by the materials Fi and Fo, and both hands can be concentrated on the sewing operation. Further, stable sewing is made possible by the material sandwiching unit 41. Therefore, particularly in sewing the two materials Fi and Fo having annular edges, operation efficiency is good.

The sewing machine 1 of this embodiment is as described above, but the present invention is not limited to the aforementioned embodiment, and the design can be appropriately modified within the scope intended by the present invention. The operational advantages of the present invention are also not limited to the foregoing embodiments. The embodiments disclosed herein should be construed in all respects as illustrative but not limiting. The scope of the present invention is not indicated by the foregoing description but by the scope of the claims. Further, the scope of the present invention is intended to include all the modifications equivalent in the sense and the scope of the claims.

What is claimed is:

1. A sewing machine comprising:

a cylinder unit configured to support two materials having annular edges by being inserted therethrough while they are stacked so that one is located on an inner wheel side and the other is located on an outer wheel side;

a stitch plate configured to abut the material on the inner wheel side that is supported by the cylinder unit so as to support it from below;

a material presser configured to press the material on the outer wheel side that is supported by the cylinder unit above the stitch plate; and a material sandwiching unit provided on a near side of the stitch plate and the material presser and configured to sandwich the two materials from above and below while they are stacked so that the material on the inner wheel side is located on the lower side and the material on the outer wheel side is located on the upper side, wherein a part of the material sandwiching unit that is located above the two materials is vertically movable, the material sandwiching unit comprises a curl-removing mechanism configured to straighten curls occurring on the edges of the two materials, the material sandwiching unit comprises inclined parts that serve as the curl-removing mechanism and have edges of shapes extending backward from a farther side of the edges of the materials toward the edge side at a position where the edges of the two materials pass therethrough, and the inclined parts have air ejectors configured to eject air so as to form airflows that straighten portions of the materials where curls have occurred.

2. The sewing machine according to claim 1, further comprising:

an edge guide located closer to a front side than the curl-removing mechanism is and configured to abut the edges of the two materials.

3. The sewing machine according to claim 1, wherein the air ejectors are constituted by a plurality of air ejection holes opening in the inclined parts.

4. The sewing machine according to claim 2, wherein the air ejectors are constituted by a plurality of air ejection holes opening in the inclined parts.

* * * * *